US005090622A

United States Patent [19]

Fohler et al.

[11] Patent Number: 5,090,622

[45] Date of Patent: Feb. 25, 1992

[54] ARRANGEMENT FOR SUPPLYING MEDIA TO A BLOWING LANCE

[75] Inventors: Johann Fohler, Puchenau; Hellmuth Smejkal, Linz; Ernst Höllwarth, Neuzeug, all of Austria

[73] Assignee: Voest-Alpine Industrieanlagenbau G.m.b.H., Linz, Austria

[21] Appl. No.: 648,556

[22] Filed: Jan. 31, 1991

[30] Foreign Application Priority Data

Feb. 1, 1990 [AT] Austria ..... 216/90
Jan. 10, 1991 [AT] Austria ..... 42/90

[51] Int. Cl.[5] ..... B05B 15/06; B05B 1/00
[52] U.S. Cl. ..... 239/273; 239/600
[58] Field of Search ..... 239/418, 591, 602, 600, 239/195, 227, 273, 280; 414/749, 750; 266/225, 226

[56] References Cited

U.S. PATENT DOCUMENTS 3,291,471 12/1966 Heyer ..... 239/418
4,494,737 1/1985 Rymarchyk et al. ..... 239/227

FOREIGN PATENT DOCUMENTS 350601 6/1979 Austria .

*Primary Examiner*—Andres Kashnikow
*Assistant Examiner*—Lesley D. Morris
*Attorney, Agent, or Firm*—Hopgood, Calimafde, Kalil, Blaustein & Judlowe

[57] ABSTRACT

In an arrangement for supplying media to a blowing lance for a metallurgical vessel including a blowing lance arranged on a lance carrier, a connection piece of the lance carrier connected to at least one media supply duct is pressable at a counter connection piece of the blowing lance such that the media supply duct is sealingly connectable to a corresponding medium channel of the blowing lance. In order to ensure the tight connection between blowing lance and lance carrier in a sinmple manner and without manual manipulations, a displacement means including a seat for the blowing lance is provided on the lance carrier to move the counter connection piece from a released position into a coupled position and vice versa. The displacement means is movable by a driving device, which presses the counter connection piece against the connection piece in the coupled position, selflockingly and positively fixing the displacement means in the coupled position.

10 Claims, 5 Drawing Sheets

ARRANGEMENT FOR SUPPLYING MEDIA TO A BLOWING LANCE

The present invention relates to an arrangement for supplying media to a blowing lance for a metallurgical vessel, in particular a steelworks converter, of the type including a blowing lance arranged on a lance carrier, wherein a connection piece of the lance carrier connected to at least one media supply duct is pressable at a counter connection piece of the blowing lance and the at least one media supply duct is sealingly connectable to a corresponding medium channel of the blowing lance.

An arrangement of this type is known from U.S. Pat. No. 3,291,471. With this known arrangement, the connection piece and the counter connection piece are designed as plate contacting each other and lying at each other. The means for applying the pressing pressure required is not illustrated in U.S. Pat. No. 3,291,471. However, it is internally known to provide screw bolts for this purpose (cf., e.g., AT-B 350,601). These must be operated by hand, which is not only time-consuming, but also cumbersome to carry out, because the lance carrier is difficult to accede. Moreover, each manual manipulation, in particular manipulations at hardly accessible sites, constitutes an error source; leakages at the connection between blowing lance and lance carrier may occur.

Since the blowing lance is to be fed with cooling water and oxygen, such a leakage, which involves the escape of these two media, is hazardous. The penetration of the media from one supply duct into the other is particularly disadvantageous, because undesired reactions of oxygen with the fats contained in the cooling water may occur at the penetration of oxygen into the water circulation and water may finally get into the converter via the blowing lance when entering the oxygen duct, causing vigorous reactions there. Furthermore, it has been endeavored to substitute, within a period of time as short as possible, a blowing lance that has become defective during operation in order to be able to terminate the refining process properly. Yet, this is impossible with screw bolts that are to be loosened manually, any substitution involving considerable time losses.

The invention aims at avoiding these disadvantages and difficulties and has as its object to provide an arrangement of the initially defined kind, in which coupling of the blowing lance to the lance carrier is feasible in a simple and quick manner, requiring no manual manipulations at the coupling site whatsoever. In addition, the safe tightness of the connection between blowing lance and lance carrier is to be ensured, which tightness is reliably maintained even during operation of the blowing lance—during which it is exposed to vibrations and oscillations.

In accordance with the invention, this object is achieved in that a displacement means including a seat for the blowing lance is provided on the lance carrier for moving the counter connection piece from a released position into a coupled position and vice versa, which displacement means is movable by a driving means, which presses the counter connection piece against the connection piece in the coupled position, thus selflockingly and positively fixing the displacement means in the coupled position.

A preferred embodiment is characterized in that the driving means comprises a toggle lever, which is movable slightly beyond its extended position in the coupled state, one of the two levers constituting the toggle lever suitably being hinged to the displacement means and the other lever being hinged to an actuation means, and in that the lever that is not hinged to the displacement means is resiliently supported on the lance carrier.

An actuation means that offers a high operational safety is characterized in that it is designed as a linear drive and is articulately fastened to the lance carrier, the actuation means advantageously being formed by two rods hinged to a lever of the toggle lever and arranged approximately diametrical relative to each other and approximately perpendicular to the extended toggle lever, each of the rods being operable by a motor.

A particularly safe reception and guidance of the blowing lance is achieved if the displacement means comprises to parallel guiding cheeks arranged at a distance from each other and movable along guide rails located on the lance carrier, each being operable by its own toggle lever, the two toggle levers being drivable synchronously.

Locking of the blowing lance in the coupled position may be obtained in a simple manner by providing each guiding cheek with an upwardly open recess or seat for retaining means disposed on the counter connection piece of the blowing lance, the upper openings of the recesses of the guiding cheeks, in the coupled position, being covered by a projection provided on the lance carrier.

In order to provide for an exact guidance of the blowing lance when pressing the counter connection piece at the connection piece and to attain an absolute tightness even with heavy blowing lances equipped with several media supply ducts, advantageously two displacement means are provided on the lance carrier, arranged one above the other and at a distance from each other, and the counter connection piece comprises retaining means corresponding to each of the recesses of the displacement means.

According to a preferred embodiment, the retaining means allocated to the displacement means disposed on one height level, in the pertaining recesses, are supported via supporting surfaces absorbing vertical and horizontal forces and the retaining means allocated to the other displacement means merely are supported via supporting surfaces absorbing horizontal forces.

A particularly simple structure, which comprises only few movable parts and in which the driving means includes a toggle lever that is movable slightly beyond its extended position in the coupled state, one of the levers constituting the toggle lever being hinged to the displacement means and one lever being hinged to the connection piece, is characterized in that one of the levers of each displacement means is comprised of two relatively movable parts extending in the axial direction of the lever and pressed by spring means into a position in which the lever has its greatest length.

In the following, the invention will be explained in more detail by way of exemplary embodiments illustrated in the drawing, wherein FIGS. 1 and 2 illustrate the arrangement in partially sectioned oblique views, with the blowing lance uncoupled and with the blowing lance being in the coupled state, respectively;

Figure 1:
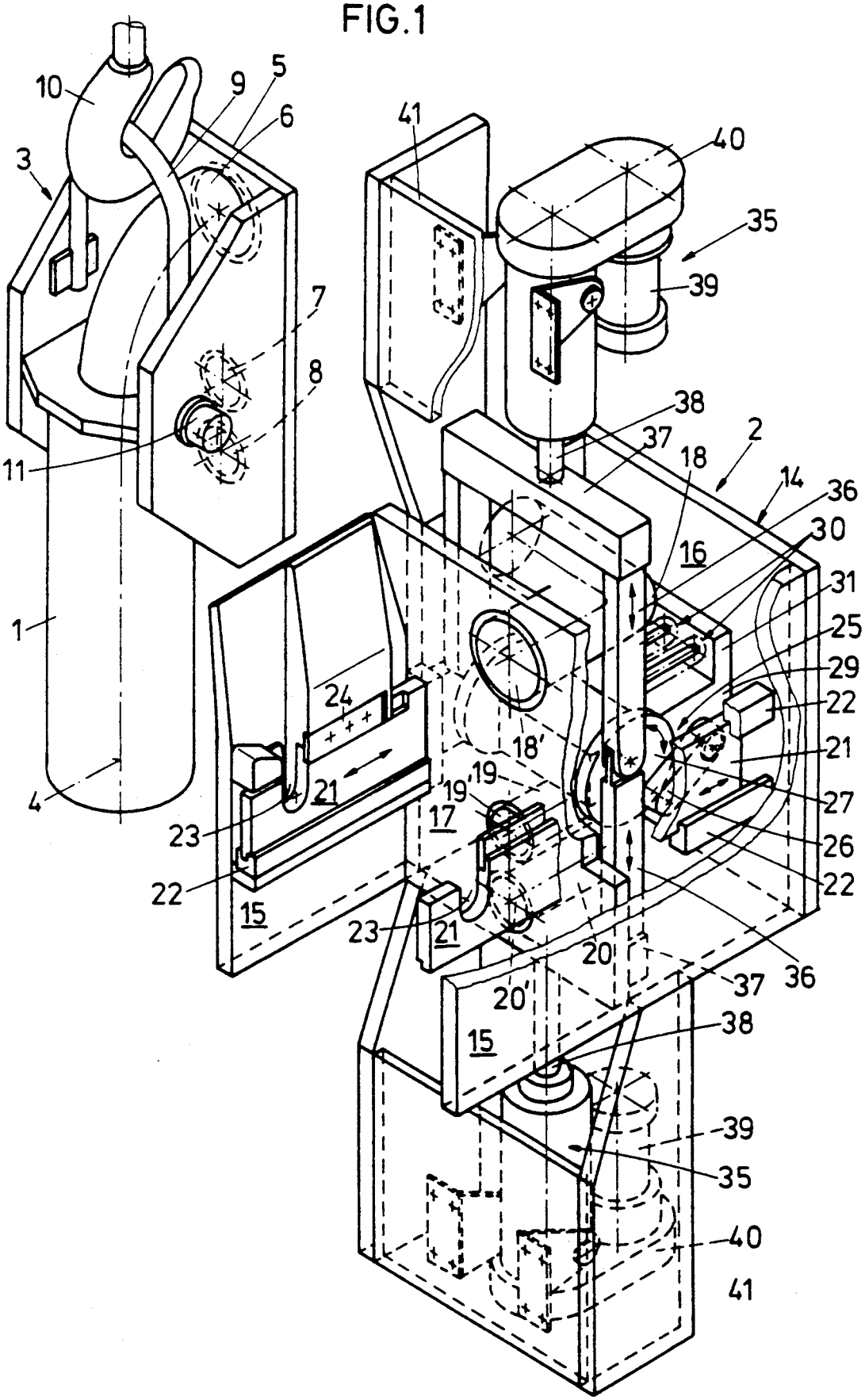

As is apparent from FIG. 1, a blowing lance 1 is movable to a lance carrier 2 by means of a load suspension device, such as a crane. The lance carrier 2 may be designed as a carriage, allowing for vertical and horizontal movements of the blowing lance 1 in order to place the blowing lance 1 from a waiting position above a converter into the blowing position.

The blowing lance 1, on its upper end, has a lance head 3, which is provided with a plate 5 parallely aligned with the longitudinal axis 4 of the blowing lance 1. Media channels 6, 7, 8, such as, e.g., an oxygen channel 6 and cooling water supply and discharge ducts 7, 8 run into this plate 5. The lance head 3 is provided with a strap 9 to be suspended into the load suspension means (which is a crane hook 10 in the exemplary embodiment illustrated). Furthermore, retaining means 11 extending perpendicular to the longitudinal axis 4 of the blowing lance 1 and directed parallel to the plate 5 are provided on the lance head 3 and are designed as round pins.

Figure 2:
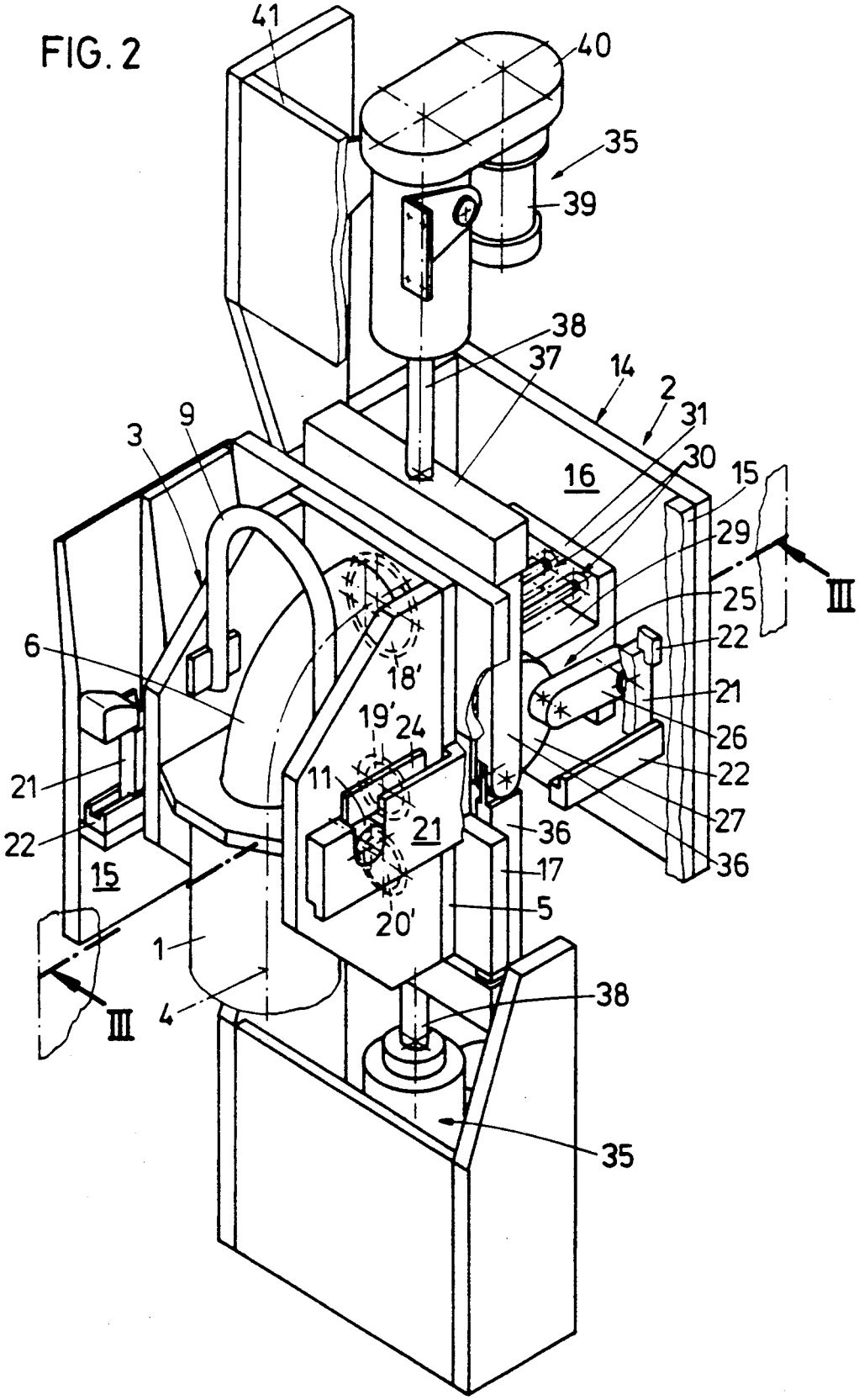
Figure 3:
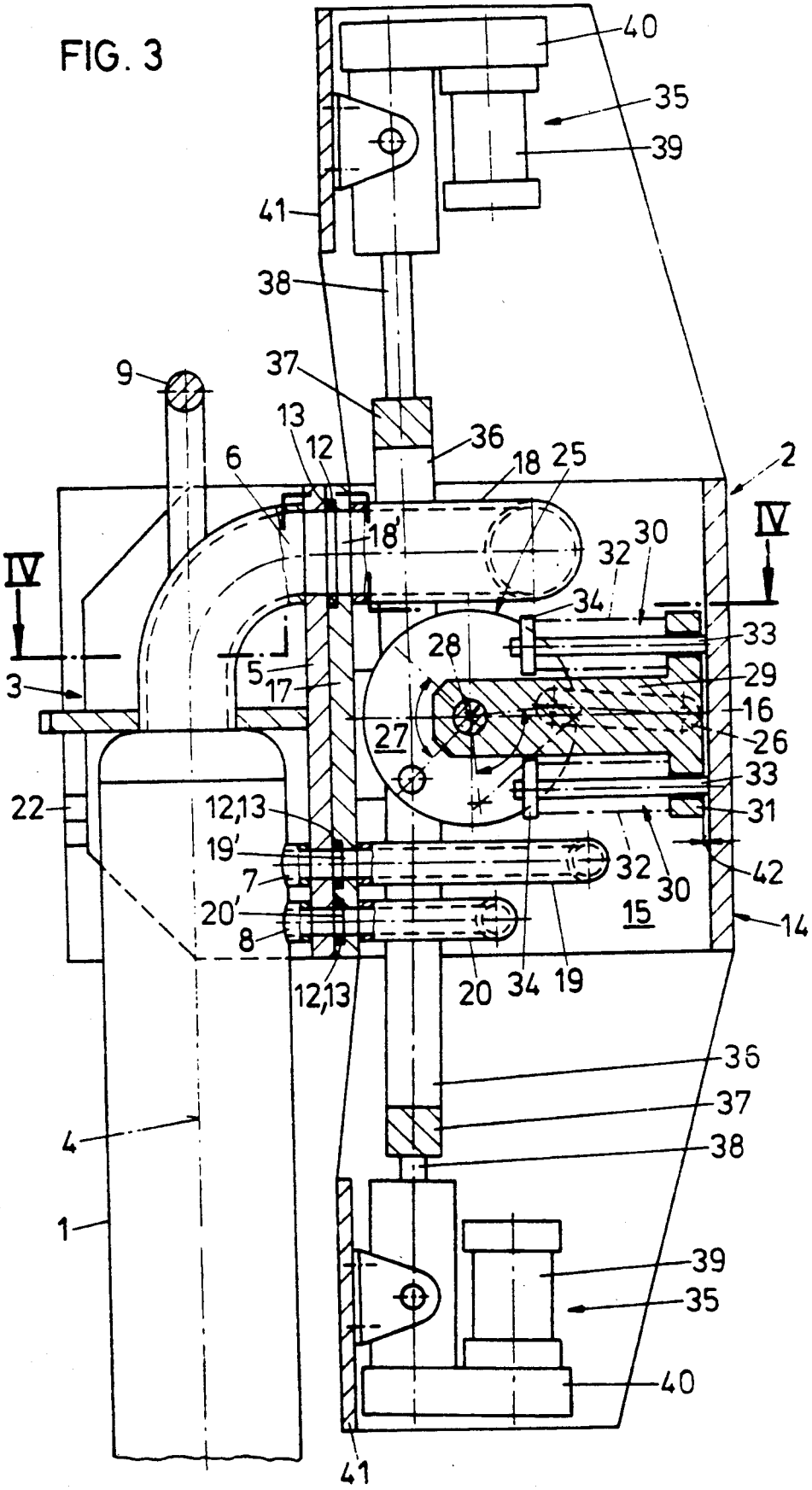
FIG. 3 is a section along line III—III of FIG. 2.
Figure 4:
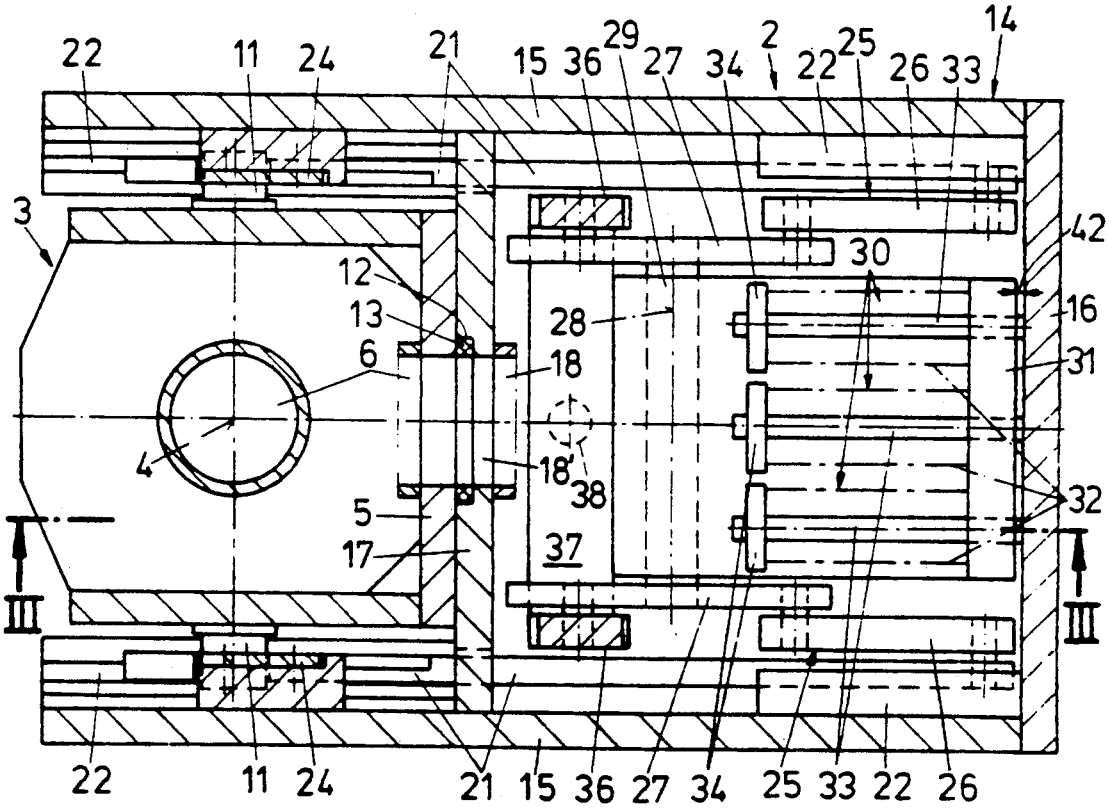
FIG. 4 is a section along line IV—IV of FIG. 3.

The lance carrier 2 is formed by a substantially U-shaped casing 14, wherein a plate-shaped connection piece 17 arranged parallel to the rear wall 16 of the casing 14 is rigidly inserted between the parallel sides 15 of the casing 14, at which connection piece the plate 5 of the lance head 3 constituting the counter connection piece is placeable and pressable as will be explained later on. Media supply ducts 18, 19, 20 run into the connection piece 17 and are arranged in a manner that their mouths 18', 19', 20' are aligned with the mouths of the media channels 6, 7, 8 within the plate of the lance head with the blowing lance 1 in the coupled position as illustrated in FIG. 2.

Annular grooves 12 surrounding the mouths 18', 19', 20' of the media supply ducts 18, 19, 20 are worked into the connection piece 17 of the casing 14, seals 13 being inserted therein. In order to prevent the media from contacting each other or one medium from getting from one channel into another in case of a leakage of these seals 13, relieving channels (not illustrated) are incorporated in the plate.

A displacement means 21 formed by two guiding cheeks arranged on the parallel sides 15 of the casing 14 and supported on guide rails 22 serves to move the lance head 3 towards the connection piece 17. These guiding cheeks 21 have U-shaped seats 23 designed as upwardly open recesses, into which the retaining means 11 provided on the lance head 3 are insertable. The guide rails 22 of the guiding cheeks 21 extend at a right angle relative to the plate-shaped connection piece 17, the blowing lance 1, thus, being movable exactly perpencidularly thereto and to the plate 5 of the lance head 3, from a released position (FIG. 1) into a coupled position (FIG. 2) and back.

Projections 24 are provided on the parallel sides 15 of the casing 14, partially overlapping the guiding cheeks 21 and causing the upwardly open U-shaped recesses 23 of the guiding cheeks 21 to be accessible from above merely in the released position (FIG. 1) of the guiding cheeks 21, while, in the coupled position (FIG. 2), they are covered by these projections 24. Thereby, it is ensured that the retaining means 11 of the lance head 3 are fixed in the recesses 24 of the guiding cheeks 21 in the coupled position.

A driving means comprising two toggle levers 25 serves to move the guiding cheeks 21 from the coupled position into the released position and vice versa and is designed in the following manner:

One lever 26 of each toggle lever 25 is hinged to one of the two guiding cheeks 21 by one end. By its other end, each lever 26 is hinged to a further lever 27 designed as a circular disc in the embodiment illustrated.

The two circular discs 27 of the two toggle levers 25 are in alignment with each other and rotatably mounted on a bracket 29 via a centrally arranged axis 28. This bracket is fastened to the rear wall 16 of the casing 14 via spring elements 30 in a manner that it is pressed at the rear wall 16 of the casing 14 by a supporting flange 31, yet may slightly be lifted off the same against the spring force of the spring elements 30. The spring elements 30 include coil or cup springs each slipped on a pin 33 passing through the supporting flange 31 of the bracket 29 and fastened to the rear wall 16, and abutting on the supporting flange 31, on the one hand and on a retaining means fastened to the free end of the pin 33, on the other hand. The spring elements 30 are biassed such that the bracket 29 is pressed at the rear wall 16 of the casing 14 by a predetermined biassing force.

The movements of the two toggle levers 25 are effected synchronously by an actuation means 35 hinged to the circular discs 27 and designed as a linear drive. The actuation means 35 comprises rods 36 hinged to the circular discs 27 and arranged approximately perpendicular to the extended toggle levers 25 and parallel to the axis 4 of the blowing lance 1 and are directed diametrical relative to each other. Two rods 36 each facing the same direction are connected by a cross beam 37 mounted to a linearly displaceable rod 38. Each displacement is effected by a motor 39, which causes the longitudinal displacement of this rod 38 via a gear 40, for instance, a spindle nut. Each of the drive units 38, 39, 40 is articulately fastened to retaining means 41 rigidly mounted to the casing 14 and extending upwardly and downwardly from the casing 14 such that the rods 36, 38 will readily follow the circular movement of the joint connecting the rods 36 with the circular disc 27 as they are moved.

The dimensions of the levers 26, 27 and of the bracket 29 are such that the bracket 29, in the released position of the displacement means 21, abuts the rear wall 16 of the casing 14 with its supporting flange 31, while, in the coupled position, in which the toggle levers 25 have been moved slightly beyond their extended state, it is disposed at a slight distance 42 from the rear wall 16 of the casing 14. Thereby, it is ensured that the connection and counter connection pieces 5 and 17 are pressed against each other, no forces being required from the actuation means 35 actuating the displacement means 21 to maintain the coupled position, i.e., in other words, the coupled position can be maintained even at a failure of the energy supply to the motors 39. However, in order to enable the blowing lance 1 to be removed in such a case, an emergency shut-off is provided, which may be designed, for instance, as a manual operating device of the actuation means 35.

Figure 5:
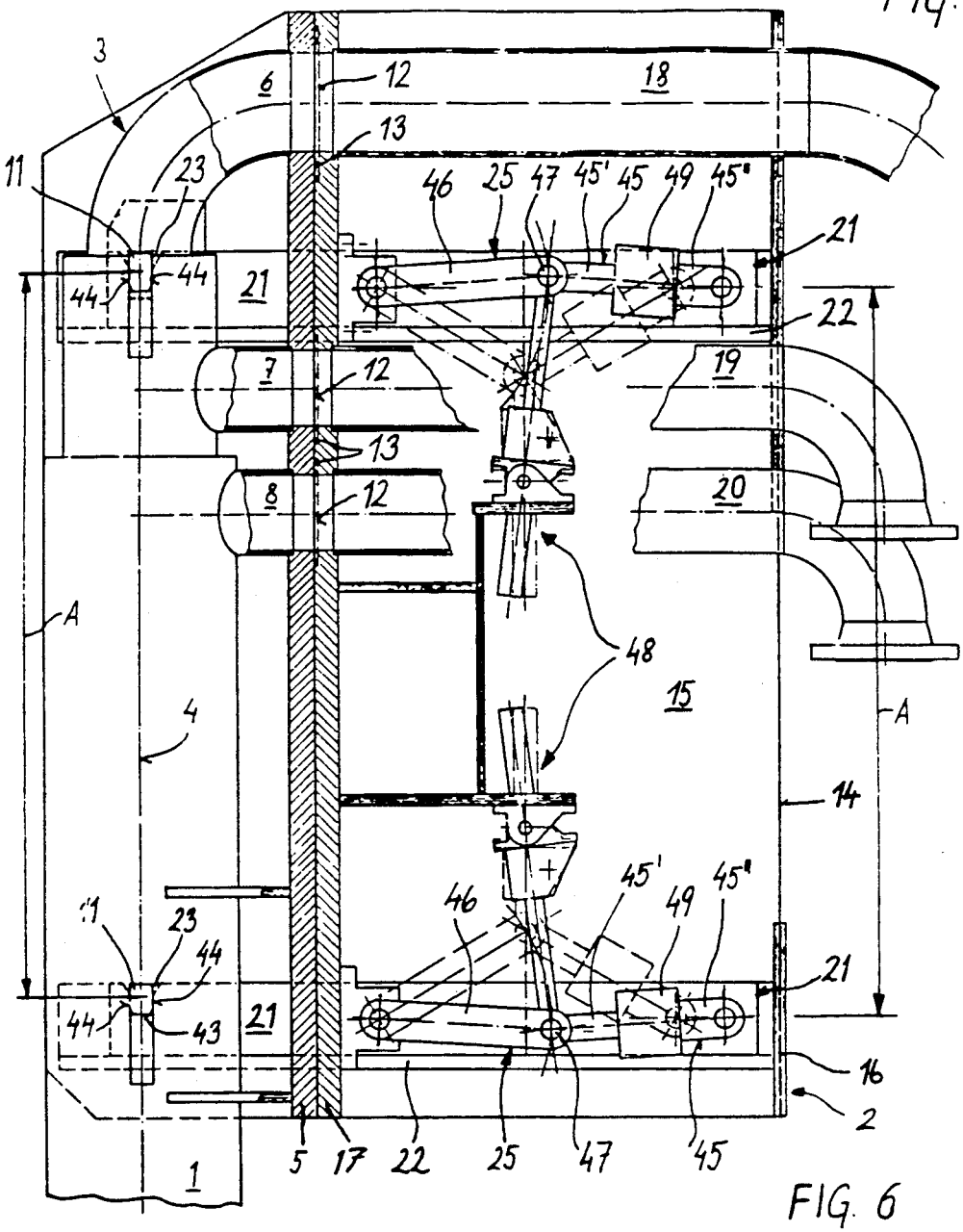
FIGS. 5 and 6 illustrate a further embodiment of the arrangement according to the invention, FIG. 5 being a longitudinal section through the arrangement and FIG. 6 being a top view onto the arrangement.
Figure 6:
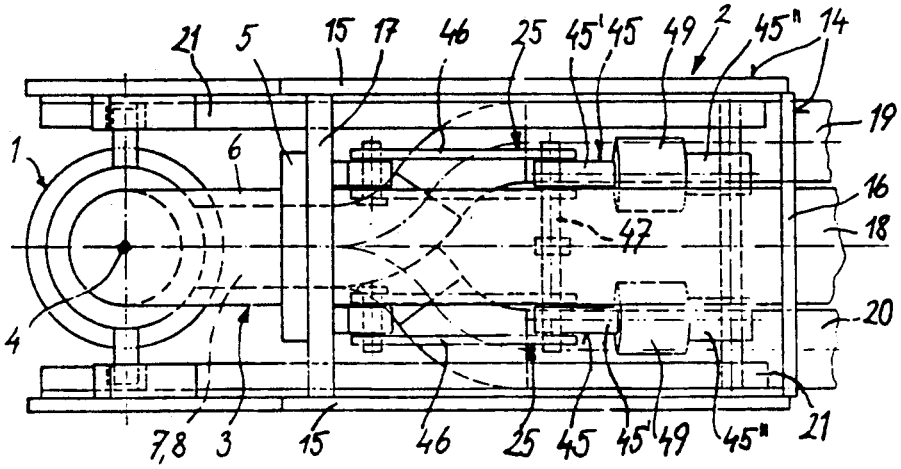

According to the embodiment illustrated in FIGS. 5 and 6, retaining means 11 having rectangular cross sections are arranged on the lance head 3 one above the other at a vertical distance A, extending perpendicular to the longitudinal axis 4 of the blowing lance 1 pairwisely on either side of the lance head 3 and directed parallel to the plate 5.

Two displacement means 21 superimposed within the casing 14 at a distance A from each other serve to move the lance head 3 towards the connection piece 17, which are each formed by two guiding cheeks 21 arranged on the parallel sides 15 of the casing 14 and supported via guide rails 22. These guiding cheeks 21 have upwardly open U-shaped seats 23, into which the retaining means 22 provided on the lance head 3 may be inserted.

The seats 23 of the guiding cheeks 21 arranged at on one height level include supporting surfaces 43, 44 absorbing both vertical and horizontal forces, whereas the seats 23 of the guiding cheeks 21 arranged on the other height level include supporting surfaces 44 merely absorbing horizontal forces.

A driving means comprising a toggle lever 25 serves to move the guiding cheeks 21 from the coupled position into the released position and vice verca, which driving means is designed as follows:

One lever 45 of one toggle lever 25 each is hinged to each of the guiding cheeks 21 by one end. By its other end, each of the levers 45 is hinged to a further lever 46 articulately supported on the plate-shaped connection piece 17. The toggle links of the toggle levers 25 arranged on one height level are connected with each other by an axle 47.

The movement of the two toggle levers 25 of the guiding cheeks 21 arranged on one height level is effected synchronously via an actuation means 48 hinged to the common axle 47 of the toggle levers 25 and designed as a linear drive.

The levers 45 each are formed by two aligned parts 45', 45'', which are relatively movable such that the levers 45 may assume different lengths. A spring means 49 provided between the parts 45' and 45'', such as, e.g., a cup spring package, presses the two parts 45' and 45'' into a position in which the length of the lever 45 is the largest.

The dimensions of the levers 45, 46 are such that the lever 45 will be shortened in its length terms of the coupled position, in which the counter connection piece, i.e., the plate 5, abuts on the connection piece 17 and the toggle levers 25 have been moved slightly beyond their extended states. Thus, it is ensured that the connection and counter connection pieces 5 and 17 are pressed at each other by the spring means 39, no forces being required from the actuation means 48 actuating the displacement means 21, to maintain the coupled position, i.e., in other words, the coupled position will be maintained even at a failure of the energy supply to the actuation means 48.

What we claim is:

1. In an arrangement for supplying media to a blowing lance for a metallurgical vessel, such as a steelworks converter, of the type including a lance carrier having a connection piece connected to at least one media supply duct, a blowing lance arranged on said lance carrier and having a counter connection piece including a corresponding media channel, said connection piece being pressable at said counter connection piece and said at least one media supply duct being sealingly connectable to said corresponding media channel, the improvement comprising a displacement means provided on said lance carrier and including a seat for said blowing lance, said displacement means being adapted to move said counter connection piece from a released state into a coupled state and vice versa, and a driving means adapted to move said displacement means and to press said counter connection piece against said connection piece in the coupled state and to selflockingly and positively fix said displacement means in the coupled state.

2. An arrangement as set forth in claim 1, wherein said driving means includes a toggle lever means, said toggle lever means being movable slightly beyond its extended position in the coupled state.

3. An arrangement as set forth in claim 2, further comprising an actuation means and wherein said toggle lever means is composed of a first lever hinged to said displacement means and a second lever hinged to said actuation means and resiliently supported on said lance carrier.

4. An arrangement as set forth in claim 3, wherein said actuation means is designed as a linear drive articulately fastened to said lance carrier.

5. An arrangement as set forth in claim 4, wherein said actuation means is comprised of two rods hinged to one of said first and second levers of said toggle lever means and arranged approximately diametrical relative to each other and approximately perpendicular to the extended toggle lever means, a motor being provided to drive each of said two rods.

6. An arrangement as set forth in claim 2, further comprising guide rails arranged on said lance carrier, and wherein said displacement means comprises two spaced-apart parallel guiding cheeks movable along said guide rails, each guiding cheek having its own toggle lever, the two toggle levers being drivable synchronously.

7. An arrangement as set forth in claim 6, further comprising retaining means provided on said counter connection piece of said blowing lance and a projection provided on said lance carrier, and wherein said guiding cheeks each include upwardly open seat means each having an upper opening for said retaining means, the upper openings of said seat means being covered by said projection in the coupled state.

8. In an arrangement for supplying media to a blowing lance for a metallurgical vessel, such as a steelworks converter, of the type including a lance carrier having a connection piece connected to at least one media supply duct, a blowing lance arranged on said lance carrier and having a counter connection piece including a corresponding media channel, said connection piece being pressable at said counter connection piece and said at least one media supply duct being sealingly connectable to said corresponding media channel, the improvement comprising two displacement means provided on said lance carrier at a level one above the other and at a distance from each other, each including a seat means for said blowing lance, said two displacement means being adapted to move said counter connection piece from a released state into a coupled state and vice versa, retaining means provided on said counter connection piece and corresponding to said seat means of each of said two displacement means, and driving means adapted to move said two displacement means and to press said counter connection piece against said connection piece in the coupled state and to selflockingly and positively fix said displacement means in the coupled position.

9. An arrangement as set forth in claim 8, further comprising vertical and horizontal forces absorbing supporting surfaces adapted to support said retaining means allocated to said displacement means disposed on one height level, within the pertaining seat means, and horizontal forces absorbing supporting surfaces adapted to support said retaining means allocated to the remaining ones of said displacement means.

10. An arrangement as set forth in claim 8, wherein said driving means include toggle lever means composed of a first lever hinged to said displacement means and of a second lever hinged to said connection piece, said toggle lever means being movable slightly beyond the extended position in the coupled state, wherein one of said first and second levers of each of said displacement means is comprised of two relatively movable parts extending in the lever axis, and further comprising spring means adapted to press said two parts into a position in which said one lever has its greatest length.

* * * * *